US011197516B2

(12) United States Patent
Chiang et al.

(10) Patent No.: US 11,197,516 B2
(45) Date of Patent: Dec. 14, 2021

(54) SHOES CAPABLE OF ADJUSTING HEEL HEIGHT

(71) Applicant: Tsung-Ju Chiang, Taipei (TW)

(72) Inventors: Tsung-Ju Chiang, Taipei (TW); Ya-Fen Huang, Taipei (TW)

(73) Assignee: Tsung-ju Chiang, Taipei (TW)

( * ) Notice: Subject to any disclaimer, the term of this patent is extended or adjusted under 35 U.S.C. 154(b) by 63 days.

(21) Appl. No.: 16/085,593

(22) PCT Filed: May 24, 2016

(86) PCT No.: PCT/CN2016/083143

§ 371 (c)(1),
(2) Date: Sep. 17, 2018

(87) PCT Pub. No.: WO2017/185439

PCT Pub. Date: Nov. 2, 2017

(65) Prior Publication Data

US 2019/0110555 A1 Apr. 18, 2019

(30) Foreign Application Priority Data

Apr. 27, 2016 (CN) ..... 201610268734.7

(51) Int. Cl.
*A43B 21/42* (2006.01)
*A43B 21/24* (2006.01)
(Continued)

(52) U.S. Cl.
CPC ..... *A43B 21/42* (2013.01); *A43B 3/24* (2013.01); *A43B 7/38* (2013.01); *A43B 9/00* (2013.01); *A43B 13/14* (2013.01); *A43B 21/24* (2013.01)

(58) Field of Classification Search
CPC ..... A43B 21/42; A43B 21/24; A43B 21/243; A43B 3/24; A43B 7/38; A43B 9/00;
(Continued)

(56) References Cited

U.S. PATENT DOCUMENTS 3,929,139 A * 12/1975 Salzman ..... A43B 21/26 36/142
4,416,072 A * 11/1983 Sarkissian ..... A43B 3/24 36/100
(Continued)

FOREIGN PATENT DOCUMENTS

CN 2376763 Y 5/2000
CN 202680689 U 1/2013
(Continued)

*Primary Examiner* — Khoa D Huynh
*Assistant Examiner* — Uyen T Nguyen
(74) *Attorney, Agent, or Firm* — CKC & Partners Co., LLC

(57) ABSTRACT

A shoe capable of adjusting heel height includes a front bracket, a rear bracket, a telescopic linkage rack, a telescopic support member, a linking member and a locking mechanism. The rear bracket is rotatably connected to the front bracket. The telescopic linkage rack is pivotally connected to the rear bracket, and can be telescoped with the movement of the rear bracket. The telescopic support member is fixedly connected to the telescopic linkage rack, and can be simultaneously telescoped in the same direction and in the same proportion with the telescoping degree of the telescopic linkage rack. The linked member is pivotally connected to the front bracket and the telescopic support member, and arranged spaced to the rear bracket, and the linked member is spaced to the rear bracket. The locking mechanism can removably fix the telescopic support member for limiting the telescopic support member.

12 Claims, 11 Drawing Sheets

(51) Int. Cl.

| | |
|---|---|
| ***A43B 7/38*** | (2006.01) |
| ***A43B 13/14*** | (2006.01) |
| ***A43B 3/24*** | (2006.01) |
| ***A43B 9/00*** | (2006.01) |

(58) Field of Classification Search
CPC ..... A43B 13/14; A43B 21/437; A43B 21/433; A43B 21/47; A43B 21/48; A43B 21/00; A43B 21/30; A43B 21/26; A43B 21/32; A43B 13/181; A43B 13/182; A43B 13/183; A43B 3/246
USPC ..... 36/100, 36 R, 36 A, 35 B, 38, 42
See application file for complete search history.

(56) References Cited

U.S. PATENT DOCUMENTS

| | | | | |
|---|---|---|---|---|
| 5,887,360 | A * | 3/1999 | Bucalo | A43B 21/42 36/100 |
| 6,021,586 | A * | 2/2000 | Bucalo | A43B 3/24 36/42 |
| 6,684,531 | B2 * | 2/2004 | Rennex | A43B 13/182 36/102 |
| 6,901,686 | B2 * | 6/2005 | Hayes | A43B 5/0415 36/115 |
| 8,707,582 | B2 * | 4/2014 | Klassen | F16F 1/025 36/27 |
| 2005/0166422 | A1 * | 8/2005 | Schaeffer | A43B 13/181 36/27 |
| 2010/0146817 | A1 * | 6/2010 | Crispo | A43B 3/24 36/100 |
| 2011/0119954 | A1 * | 5/2011 | Ortiz | A43B 21/46 36/42 |
| 2012/0055048 | A1 * | 3/2012 | Haupt | A43B 21/437 36/34 R |
| 2013/0160329 | A1 * | 6/2013 | Peyton | A43B 13/28 36/105 |
| 2014/0165428 | A1 * | 6/2014 | Freschi | A43B 13/141 36/102 |
| 2015/0007456 | A1 * | 1/2015 | Klassen | A43B 21/30 36/102 |
| 2015/0157087 | A1 * | 6/2015 | Blumenthal | A43B 3/24 36/100 |
| 2015/0201704 | A1 * | 7/2015 | Huber | A43B 21/42 36/25 R |
| 2017/0119090 | A1 * | 5/2017 | Chang | A43B 7/1445 |
| 2017/0231316 | A1 * | 8/2017 | Sethi | A43B 3/128 36/97 |

FOREIGN PATENT DOCUMENTS

| | | | |
|---|---|---|---|
| CN | 103238981 | A | 8/2013 |
| CN | 203290309 | U | 11/2013 |
| CN | 205093678 | U | 3/2016 |
| CN | 205568038 | U | 9/2016 |
| FR | 2959646 | A1 * | 11/2011 |
| KR | 20020032276 | A | 5/2002 |
| KR | 20090079129 | A | 7/2009 |
| KR | 200468008 | Y1 | 7/2013 |
| KR | 20130006105 | U | 10/2013 |

* cited by examiner

SHOES CAPABLE OF ADJUSTING HEEL HEIGHT

RELATED APPLICATIONS

This application is a continuation of International application No. PCT/CN2016/083143, filed on May 24, 2016 which claims the benefits of priority of CN application No. 201610268734.7, filed on Apr. 27, 2016, the content of which are incorporated herein by reference.

FIELD OF DISCLOSURE

The disclosure relates to a shoe, and more particularly to a shoe capable of adjusting heel height.

DESCRIPTION OF RELATED ART

In order to be polite or to seem taller, a lady normally wears high-heel shoes when going out, however, as wearing high-heel shoes for a long time, the feet of the lady may contract edema or a sprained ankle, so that not only the lady is easy to fall down, but also ankle injury may be caused to the lady thereby affecting the health of the lady and providing uncomfortable experience. Therefore, a user may carry both of a pair of flat shoes and a pair of high-heel shoes at the same time, or carry two high-heel shoes with different heights alternatively so as to meet the need of the user.

Accordingly, many kinds of high-heel shoes able to be changed the length of the heel are available in the market. However, product designs of these kinds of high-heel shoes are often complicated and inconvenient, thereby reducing the willingness of users to purchase and use.

Therefore, ways to provide a solution to effectively solve the aforementioned inconvenience and shortages and to increase the competitiveness of industries will be seriously concerned.

SUMMARY

An objection of the disclosure is to provide a shoe capable of adjusting heel height, which can solve the problem mentioned above, that is, the product design of a high-heel shoe is simplified so as to improve the willingness of users to purchase and use.

According to one embodiment, the shoe capable of adjusting heel height includes a front bracket, a rear bracket, a telescopic linkage rack, a telescopic support member, a linking member and a locking mechanism. The rear bracket is rotatably connected to the front bracket. The telescopic linkage rack is pivotally connected to the rear bracket, and is used to be telescoped with the movement of the rear bracket. The telescopic support member is fixedly connected to the telescopic linkage rack, and is used to be simultaneously telescoped in the same direction and in the same proportion with the telescoping degree of the telescopic linkage rack. The linking member is pivotally connected to the front bracket and the telescopic support member, and is arranged spaced to the rear bracket. The locking mechanism is used to removably fix the telescopic support member for limiting the telescoping degree of the telescopic support member.

Thus, when a user's human foot puts into the shoe of the embodiment, and the user lifts a heel part of the human foot to bend a toe part of the human foot, by folding the rear bracket in relative to the front bracket, the telescopic support member can be retracted with the movement of the linking member and the rear bracket for changing the length of the telescopic support member. Therefore, in the embodiment, the extending length of the telescopic support member can be controlled to meet the user's requirements in accordance with the bending degrees of the shoe board, thereby solving the problem that the user must have high-heel shoes with different heel heights at the same time.

In one or more embodiments of the disclosure, the telescopic linkage rack includes a plurality of first shaft pins, a plurality of second shaft pins, a plurality of first connecting rods and a plurality of second connecting rods. The first connecting rods are parallel one another. The second connecting rods are parallel one another. Each of the first connecting rods and each of the second connecting rods which are adjacent with each other are crossed to be pivotally connected to each other through one of the first shaft pins. The first connecting rods and the second connecting rods are further pivotally connected to one another with an end-to-end manner through the second shaft pins. When the first connecting rods and the second connecting rods are rotated to gradually alter gaps between the first shaft pins from each other, the length of the telescopic linkage rack is correspondingly changed.

In one or more embodiments of the disclosure, the rear bracket is pivotally connected to one of the first connecting rods through one of the first shaft pins and one of the second shaft pins. When the rear bracket moves the telescopic linkage rack to change the length of the telescopic linkage rack correspondingly, the telescopic linkage rack is moved laterally.

In one or more embodiments of the disclosure, the telescopic support member includes a plurality of sleeves. The sleeves are arranged concentrically and telescopically sleeved one another in sequence. At least two of the first shaft pins are fixedly connected to at least two of the sleeves in sequence along a major axis direction of the telescopic support member.

In one or more embodiments of the disclosure, the innermost one of the sleeves is formed with a through space therein, and the telescopic linkage rack is received within the through space.

In one or more embodiments of the disclosure, the outermost one of the sleeves is formed with a plurality of securing holes. The securing holes are arranged along an arc-lined arrangement.

In one or more embodiments of the disclosure, the locking mechanism includes a fixing pin. The fixing pin is pluggably inserted one of the securing holes for fixing the sleeves to determine one of various lengths that the telescopic linkage rack is able to be changed correspondingly.

In one or more embodiments of the disclosure, the locking mechanism further includes a frame body, a spring and an operating portion. The frame body has a first end, a second end and a pivotal portion disposed between the first end and the second end. The fixing pin is disposed on the first end of the frame body. The spring is connected to the first end of the frame body, for pushing the fixing pin back to the securing hole. One end of the operating portion is abutted against the second end of the frame body, and the other end of the operating portion is exposed outwards from the shoe. Therefore, when the operating portion rotates the frame body, the fixing pin is withdrawn from the one of the securing holes with the rotation of the frame body to release from fixing the sleeves.

In one or more embodiments of the disclosure, one end of the front bracket is provided with a protruding rib. The rear bracket is pivotally connected to the end of the front bracket through at least one first pivot, and pivotally connected to the telescopic linkage rack through at least two second pivots, the linking member is pivotally connected to the protruding rib through at least one third pivot, and pivotally connected to the telescopic support member through at least one fourth pivot. A linkage constrained assembly is collectively defined by the protruding rib of the front bracket, the rear bracket, the telescopic linkage rack, the telescopic support member and the linking member. The first pivot, the second pivots, the third pivot and the fourth pivot are parallel one another.

According to another embodiment, the shoe capable of adjusting heel height includes a shoe body, a shoe sole layer, a linkage constrained assembly and a locking mechanism. The shoe sole layer has a penetrating opening. The linkage constrained assembly is connected to the shoe body and the shoe sole layer, and the linkage constrained assembly includes a front bracket, a rear bracket, a retractable shoe-heel and a linking member. The front bracket is provided with a protruding rib. The rear bracket is rotatably connected to the front bracket. The retractable shoe-heel is retractably received within the penetrating opening, and pivotally connected to the rear bracket. The linking member is arranged spaced to the rear bracket, and pivotally connected to the protruding rib and the retractable shoe-heel. The locking mechanism is used to removably fix the retractable shoe-heel for limiting the telescoping degree of the telescopic support member. Thus, when the linkage constrained assembly is operated to be retracted, the retractable shoe-heel is retracted with the movement of the linking member and the rear bracket for changing a length of the retractable shoe-heel.

In one or more embodiments of the disclosure, the retractable shoe-heel includes a telescopic linkage rack and a telescopic support member. The telescopic linkage rack is pivotally connected to the rear bracket, and is used to be telescoped with the movement of the rear bracket and the linking member. The telescopic support member is fixedly connected to the telescopic linkage rack, and used to be simultaneously telescoped in the same direction and in the same proportion with the telescoping of the telescopic linkage rack.

Compared with the prior art, the disclosure is provided with following beneficial effects: a shoe capable of adjusting heel height of the disclosure is able to simplify the product design of a high-heel shoe so as to improve the willingness of users to purchase and use.

It is to be understood that both the foregoing general description and the following detailed description are by examples, and are intended to provide further explanation of the disclosure as claimed.

BRIEF DESCRIPTION OF THE DRAWINGS

In order to make the aforesaid as well as other aspects, features, advantages, and embodiments of the disclosure more apparent, the accompanying drawings are described as follows.

DESCRIPTION OF THE EMBODIMENTS

Figure 1A:
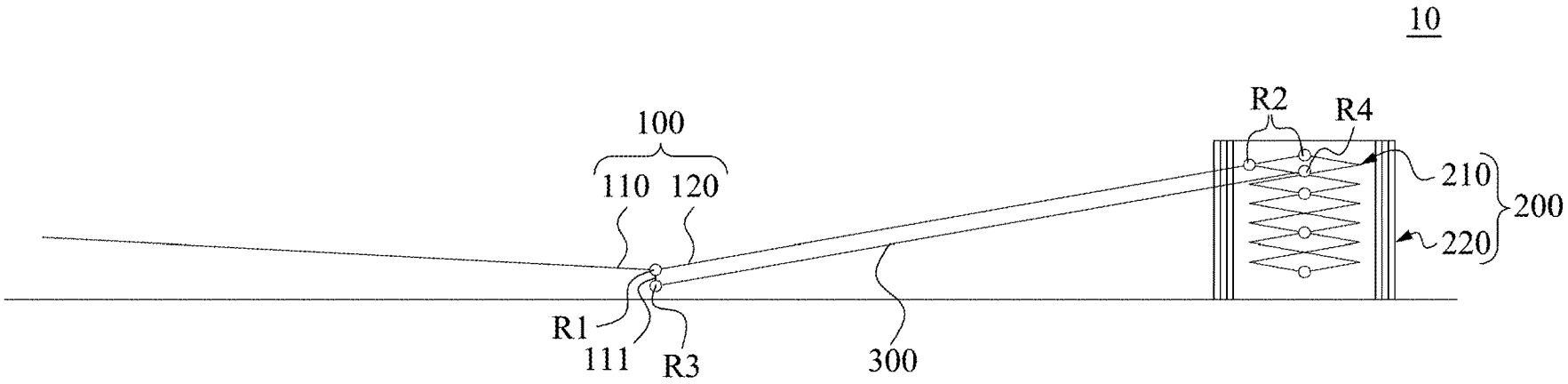
FIG. 1A-FIG. 1B depict simplified operation schematic views of a shoe capable of adjusting heel height according to one embodiment of the disclosure.

Hereinafter, the plural embodiments of the disclosure will be disclosed by way of example, and a number of practical details will be described in the following description for clarity of explanation. It will be understood by those skilled in the art, however, that these practical details are not necessary in the presently described embodiments, and are not intended to limit the disclosure. In addition, for the sake of simplicity of schema, some conventionally preferred structures and elements will be schematically illustrated in the drawings. In addition, in order to facilitate the reader to watch, the size of the elements in the figure is not according to the actual proportion of drawings.

Figure 1B:
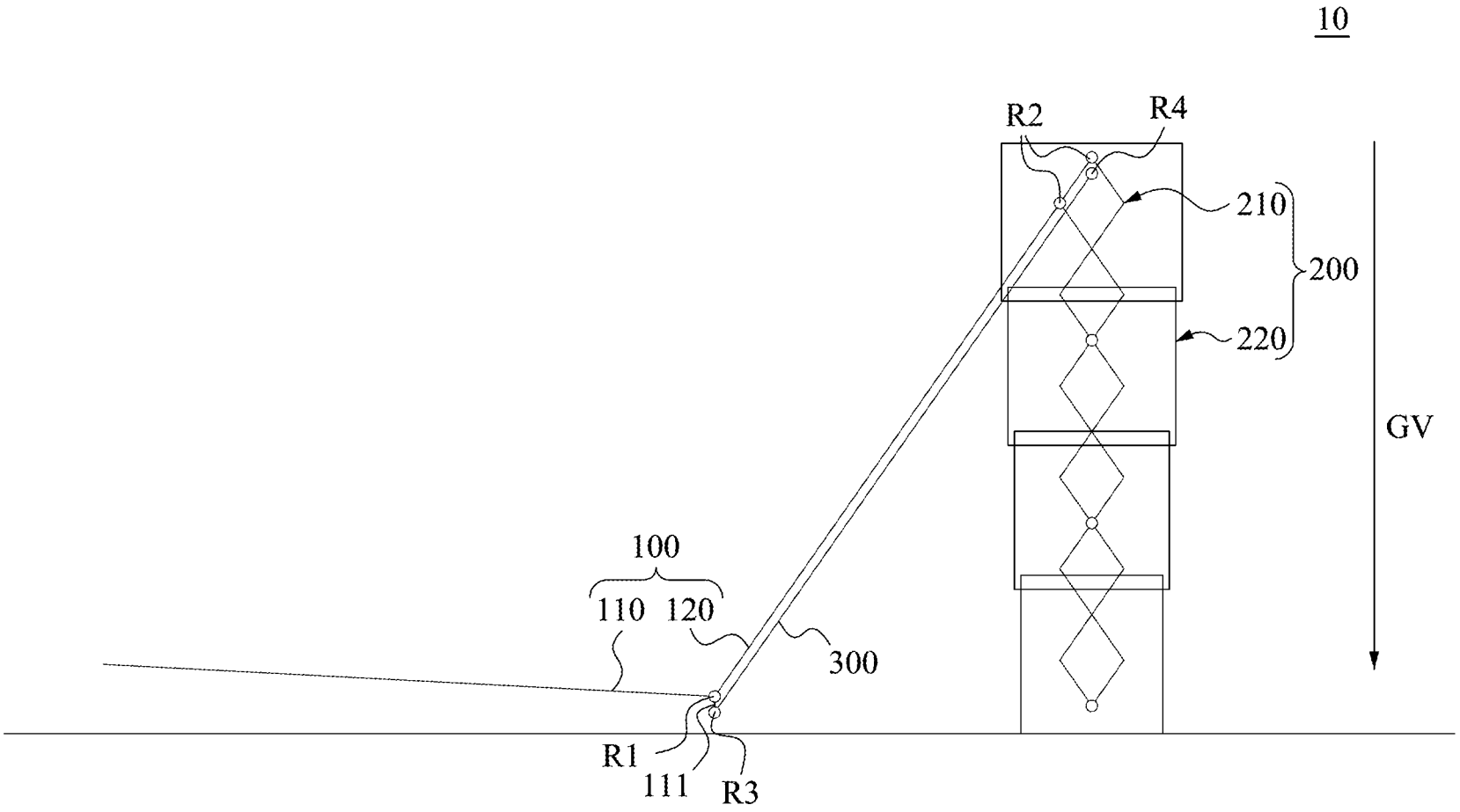

FIG. 1A-FIG. 1B depict simplified operation schematic views of a shoe 10 capable of adjusting heel height according to one embodiment of the disclosure. As shown in FIG. 1A-FIG. 1B, the shoe 10 of the embodiment includes a shoe plate 100 and a retractable shoe-heel 200. The shoe plate 100 is used to carry a single human foot of the user (not shown). The shoe plate 100 includes a front bracket 110, a rear bracket 120 and a linking member 300. The rear bracket 120 is rotatably connected to one side of the front bracket 110 through for example a pivot or a crease mark. The retractable shoe-heel 200 is shown in a long column shape, and the retractable shoe-heel 200 can be retracted to change the length (or height) of the retractable shoe-heel 200. One end of the retractable shoe-heel 200 is pivotally connected to one side of the rear bracket 120 which is opposite to the front bracket 110. The front bracket 110 is provided with a protruding rib 111. The protruding rib 111 extends outwards from the side of the front bracket 110. The linking member 300 is arranged spaced to the rear bracket 120, and two opposite ends of the linking member 300 are pivotally connected to the protruding rib 111 of the front bracket 110 and the retractable shoe-heel 200 respectively. Thus, a linkage constrained assembly (e.g., four-bar linkage) is collectively defined by the protruding rib 111, the rear bracket 120, the retractable shoe-heel 200 and the linking member 300.

Thus, when the linkage constrained assembly is operated to be retracted, for example, the rear bracket 120 is rotated relative to the front bracket 110, through the linking movement of the rear bracket 120 and the linking member 300, the retractable shoe-heel 200 of the embodiment can be telescoped along a gravity direction GV so as to change the length of the retractable shoe-heel 200. Therefore, the user's requirements can be met and the problem that the user must have high-heel shoes with different heel heights at the same time can be solved.

For example, the retractable shoe-heel 200 includes a telescopic linkage rack 210 and a telescopic support member 220. The telescopic linkage rack 210 is able to be retracted and extended. The telescopic linkage rack 210 is pivotally connected to one side of the rear bracket 120 which is opposite to the front bracket 110 so that the telescopic linkage rack 210 can be telescoped with the collective movement of the rear bracket 120 and the linking member 300 so as to change a total length of the telescopic linkage rack 210. The telescopic support member 220 is pivotally connected to one side of the linking member 300 which is opposite to the protruding rib 111. The telescopic support member 220 is able to be retracted and extended, and the telescopic support member 220 is fixedly connected to the telescopic linkage rack 210. Thus, the telescopic support member 220 can be simultaneously telescoped in the same direction and in the same proportion with the telescoping degree of the telescopic linkage rack 210.

More specifically, the rear bracket 120 is pivotally connected to the front bracket 110 through at least one first pivot R1, and pivotally connected to the telescopic linkage rack 210 through a number of (e.g., two) second pivots R2, so that the rear bracket 120 is rotatable relative to the front bracket 120 about the first pivot R1. The telescopic linkage rack 210 is rotatable relative to the rear bracket 120 about the second pivot R2. The linking member 300 is pivotally connected to the protruding rib 111 through at least one third pivot R3, and pivotally connected to the telescopic support member 220 through at least one fourth pivot R4 so that the linking member 300 can be rotated relative to the protruding rib 111 about the third pivot R3, and the telescopic support member 220 can be rotated relative to the linking member 300 about the fourth pivot R4. Be aware that the first pivot R1, the second pivots R2, the third pivot R3 and the fourth pivot R4 are parallel one another, but are not coaxial.

Figure 2A:
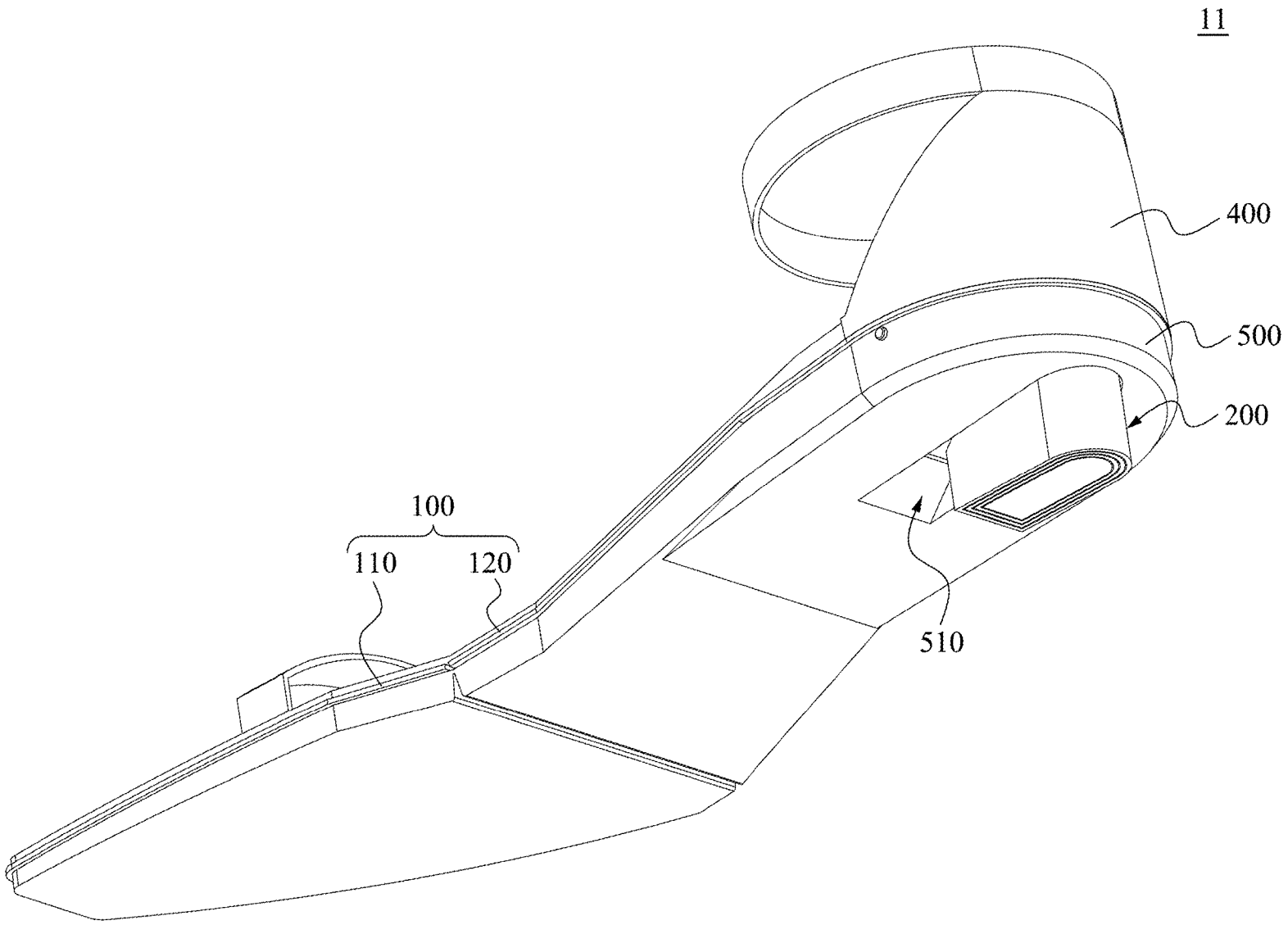
FIG. 2A depicts a perspective view of a shoe capable of adjusting heel height according to another embodiment of the disclosure.
Figure 2B:
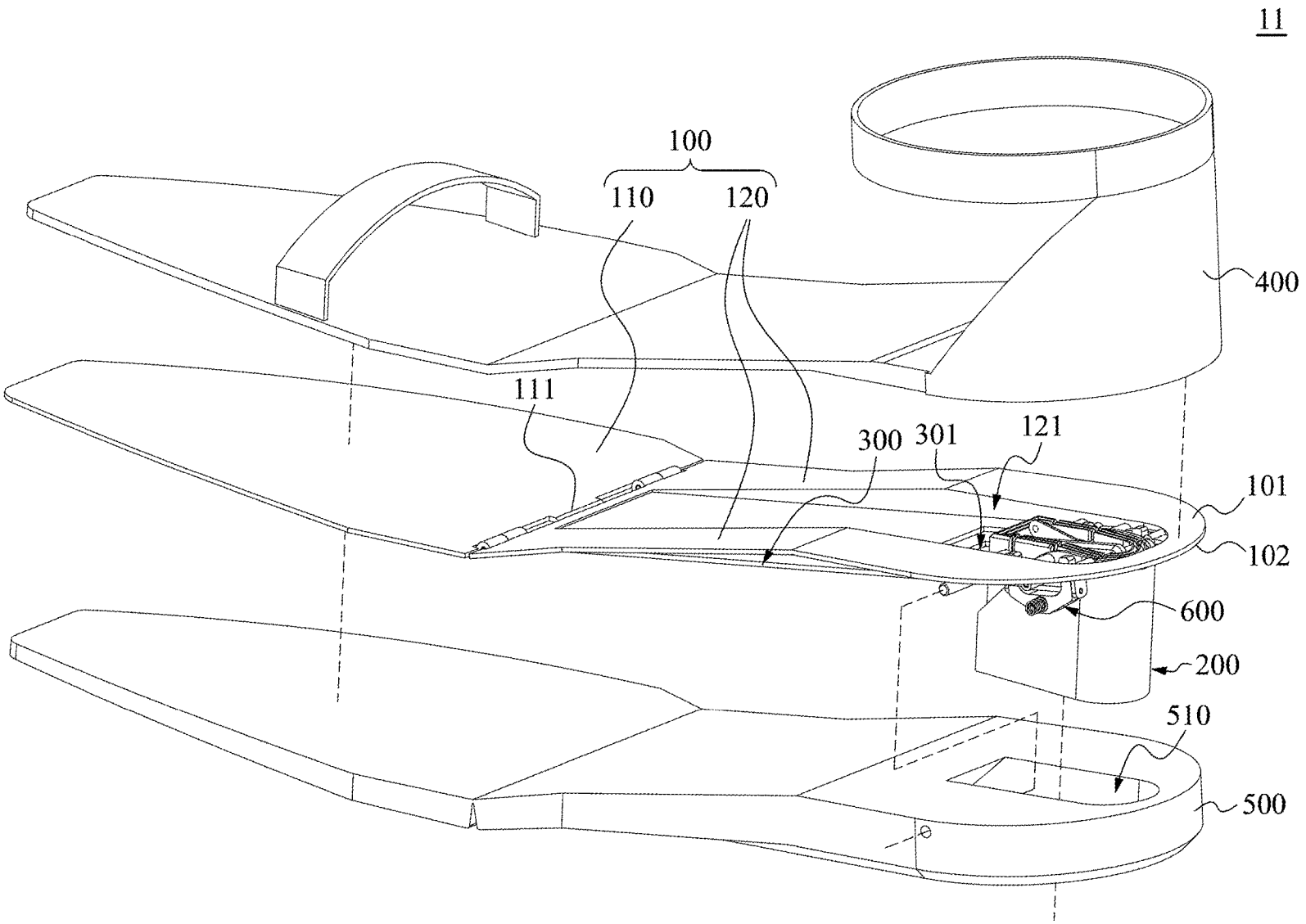
FIG. 2B depicts an explosive view of the shoe of FIG. 2A.

FIG. 2A depicts a perspective view of a shoe 11 capable of adjusting heel height according to another embodiment of the disclosure. FIG. 2B depicts an explosive view of the shoe of FIG. 2A. Besides the shoe plate 100, the retractable shoe-heel 200 and the linking member 300 mentioned above, the shoe 11 of the embodiment further includes a shoe body 400, a shoe sole layer 500 and at least one locking mechanism 600. The shoe body 400, for example, includes shoe material for fully or partially covering the human foot of the user. Be aware that the shoe body 400 in the disclosure can be generally referred to any appearance of all kind of shoes, and the disclosure is not limited to the style shown in the drawings thereof. The shoe plate 100 is disposed between the shoe body 400 and the shoe sole layer 500, and respectively connected to the shoe body 400 and the shoe sole layer 500. The shoe sole layer 500 is formed with a penetrating opening 510 which is aligned with the rear bracket 120. The retractable shoe-heel 200 extends outwards from the shoe sole layer 500 via the penetrating opening 510. The locking mechanism 600 is connected to the shoe plate 100 so as to removably fix the retractable shoe-heel 200 for limiting the telescoping degree of the retractable shoe-heel 200 and determining the current length of the retractable shoe-heel 200. Also, in the embodiment, the shoe sole layer 500 further covers the locking mechanism 600, the linking member 300 and a part of the shoe plate 100 therein. However, the disclosure is not limited thereto.

Specifically, the shoe plate 100 is provided with an upper side face 101 and a lower side face 102 which are arranged oppositely with each other. The shoe body 400 is disposed on the upper side face 101 of the shoe plate 100, and the retractable shoe-heel 200, the linking member 300 and the shoe sole layer 500 are collectively disposed on the lower side face 102. In addition, the rear bracket 120 of the shoe plate 100 is further formed with a recess 121. The recess 121 exposes a part of the sole layer 500 and the penetrating opening 510. The linking member 300 is further formed with a break 301 exposing the penetrating opening 510 and the recess 121, and the retractable shoe-heel 200 is received within the penetrating opening 510, the recess 121 and the break 301.

Figure 3:
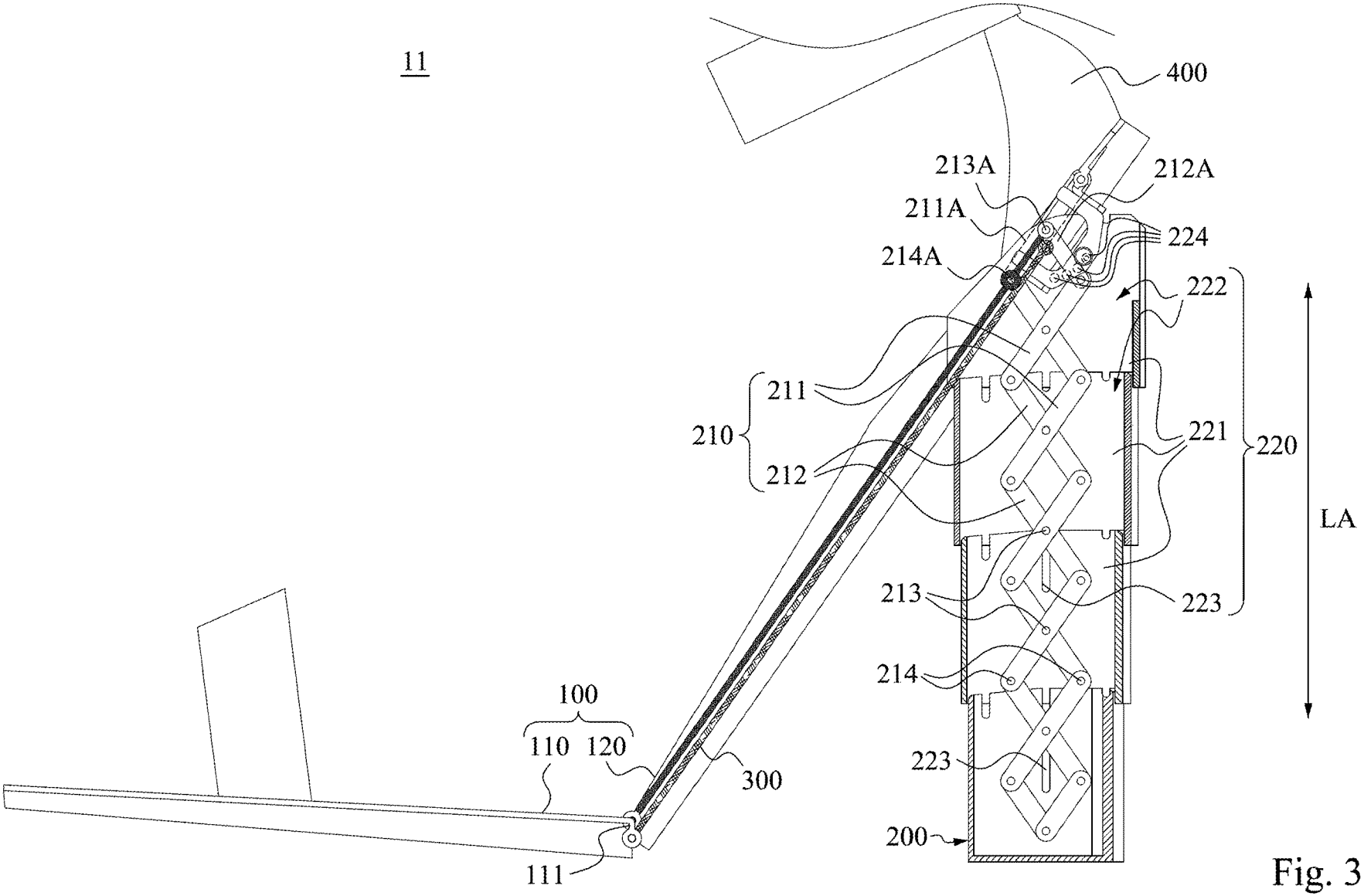
FIG. 3 depicts an operation schematic view of the shoe of FIG. 2A.
Figure 4:
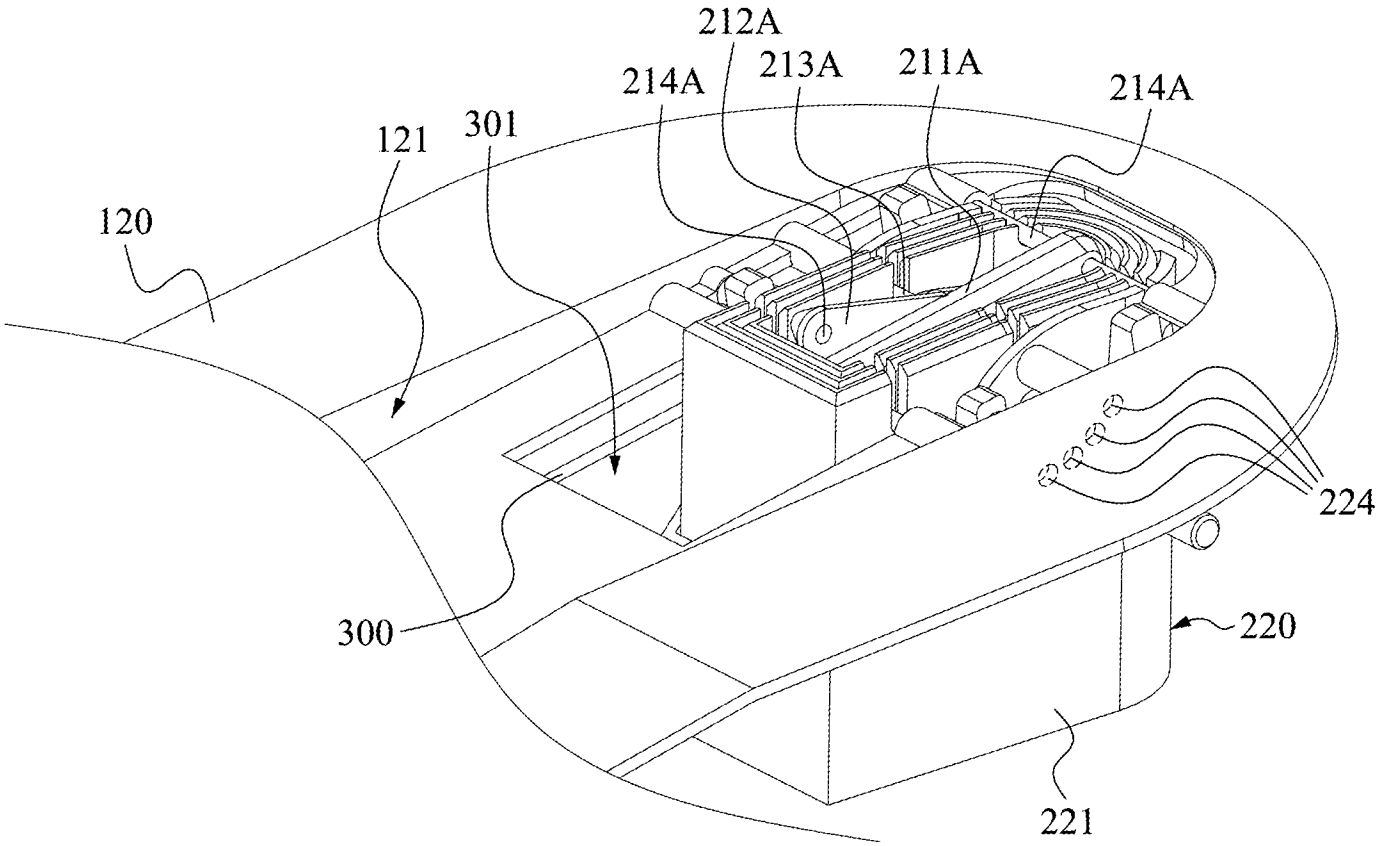
FIG. 4 depicts a schematic view of a retractable shoe-heel of FIG. 2A.

FIG. 3 depicts an operation schematic view of the shoe 11 of FIG. 2A. FIG. 4 depicts a schematic view of a retractable shoe-heel 200 of FIG. 2A. As shown in the FIG. 3 and FIG. 4, in the embodiment, the telescopic support member 220 includes a plurality of sleeves 221. The sleeves 221 are concentrically arranged with each other and are telescopically sleeved one another in sequence in the major axis direction LA of the telescopic support member 220. In details, each of the sleeves 221 is formed with a through space 222 therein, that is, each of the sleeves 221 surrounds its through space 222. In any two adjacent sleeves 221, one of the sleeves 221 is received within the through space 222 of the other sleeve 221. In an order from the outside to the inside, the sizes of these sleeves 221 are gradually increased from large to small. Thus, by pulling or pushing the sleeves 221, the length of the telescopic support member 220 can be changed. However, the disclosure is not limited thereto, as long as the sleeves can be sequentially sleeved, the sleeves are not limited to be in a same appearance type.

In addition, as long as the telescopic linkage rack can fix several or all of the sleeves sequentially, the telescopic linkage rack does not have to be received inside the telescopic support member. In other embodiments, the telescopic linkage rack can be placed outside the telescopic support abreast (not shown).

Furthermore, the telescopic linkage rack 210 includes a plurality of first connecting rods 211, a plurality of second connecting rods 212, a plurality of first shaft pins 213 and a plurality of second shaft pins 214. Each of the first connecting rods 211 and each of the second connecting rods 212 which are adjacent with each other are crossed to be pivotally connected to each other through one of the first shaft pins 213. The first connecting rods 211 and the second connecting rods 212 are further pivotally connected to one another with an end-to-end manner through the second shaft pins 214. The first connecting rods 211 are parallel one another, however, these first connecting rods 211 are not limited to be in the same length or the same type. The second connecting rods 212 are parallel one another, however, these second connecting rods 212 are not limited to be in the same length or the same type. Also, the first connecting rods 211 and the second connecting rods 212 are not limited to be in the same length or the same type.

Thus, when the first connecting rods 211 and the second connecting rods 212 are rotated to gradually alter (e.g., reduced or enlarged) gaps between the first shaft pins 213 from each other, the length of the telescopic linkage rack 210 is correspondingly changed (e.g., reduced or enlarged).

It is noted, since the telescopic linkage rack 210 is located in the through space 222 of the innermost one of the sleeves 221, and several or all of the first shaft pins 213 are respectively fixedly connected to several or all of the sleeves 221 along the major axis direction LA of the telescopic linkage rack 210 sequentially, thus, the telescopic support member 220 can be simultaneously telescoped in the same direction and in the same proportion with the telescoping degree of the telescopic linkage rack 210.

In practice, in order to give way for the first shaft pins 213 of the sleeve 221 so as to fold the sleeves 221 together, except for a part of the sleeve 221 connecting to the linking members 300, each of the remaining of the sleeves 221 is respectively provided with a slit 223. In an order from the outside to the inside of the sleeves 221, the slits 223 of the sleeves 221 are gradually changed from small to large in length.

As shown in FIG. 3 and FIG. 4, one of the first connecting rods (e.g., the first connecting rods 211A closest to the shoe body 400) is symmetrically pivotally connected to the rear bracket 120 through two shaft pins (e.g., the first shaft pin 213A and the second shaft pin 214A). Thus, when the rear bracket 120 is rotated relative to the front bracket 110 to collectively move the telescopic linkage rack 210 to telescope in the gravity direction GV, because the rear bracket 120 only moves the first connecting rods 211A to be rotated, the second connecting rods 212A can only move with the first connecting rods 211A, and the first connecting rods 211A and the second connecting rods 212A are not rotated at the same angle at the same time. Thus, when the rear bracket 120 moves the telescopic linkage rack 210 to change the length of the telescopic linkage rack 210 correspondingly, the telescopic linkage rack 210 is moved laterally at the same moment (see FIG. 1A and FIG. 1B as references).

In other words, when the first connecting rods 211A of the telescopic linkage rack 210 are stopped rotating, the telescopic linkage rack 210 and the telescopic support member 220 can be prevented from being telescopic in the gravity direction, therefore, the lengths of the telescopic linkage rack 210 and the telescopic support member 220 (i.e., retractable shoe-heel 200) which are exposed outwards from the shoe 10 can be fixed.

In order to position and stop the first connecting rods 211A rotating of the telescopic linkage rack 210, in the embodiment, the outermost sleeve 221 is formed with a plurality of securing holes 224. The securing holes 224 are arranged on the outermost sleeve 221 along an arc-lined arrangement which matches the trajectory curvature of the displacement of the telescopic linkage rack 210.

Because each of the securing holes 224 corresponds to one of various lengths that the telescopic linkage rack 210 is able to be changed correspondingly, for example, the telescopic support member 220 has four securing holes 224. When each of the securing holes 224 is plugged for limiting the displacement of the telescopic linkage rack 210, four different lengths of the retractable heel 200 which are extended outwardly can be provided.

Figure 5:
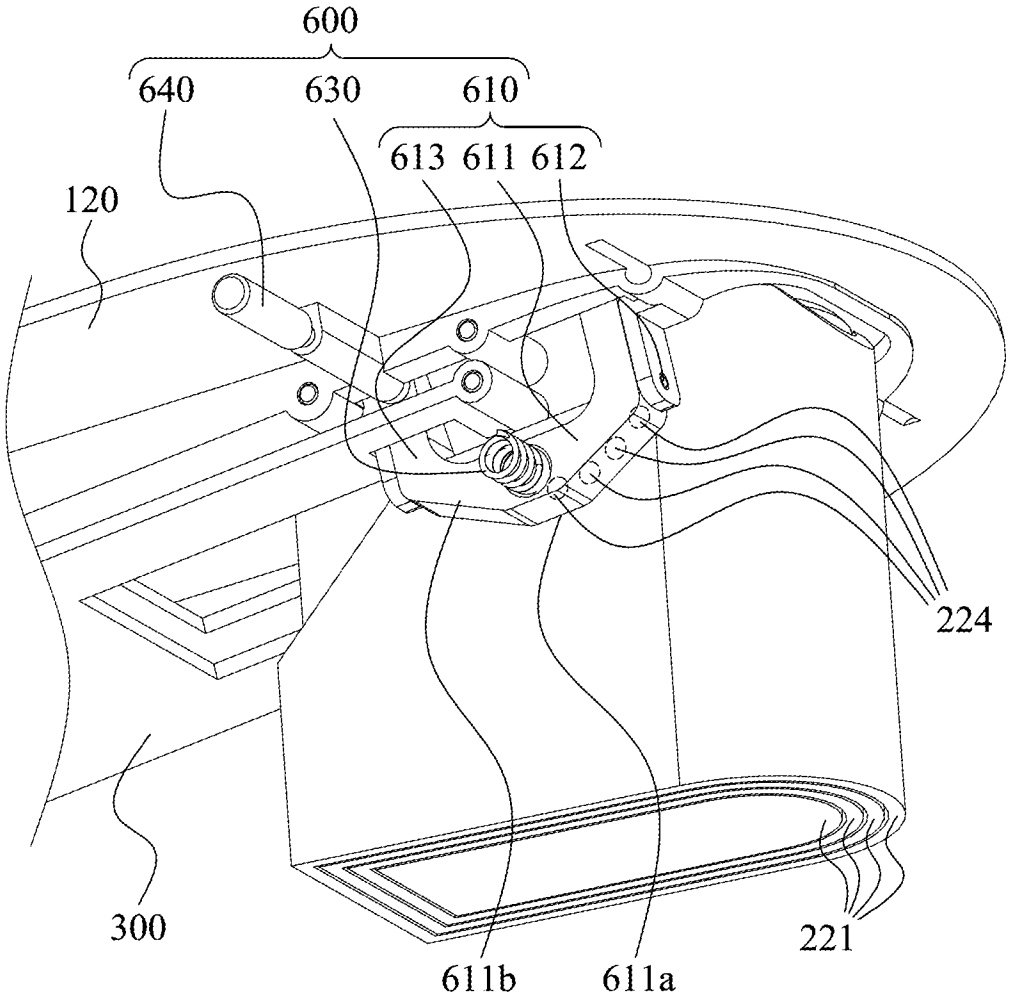
FIG. 5 depicts a schematic view of a locking mechanism of FIG. 2A.
Figure 6:
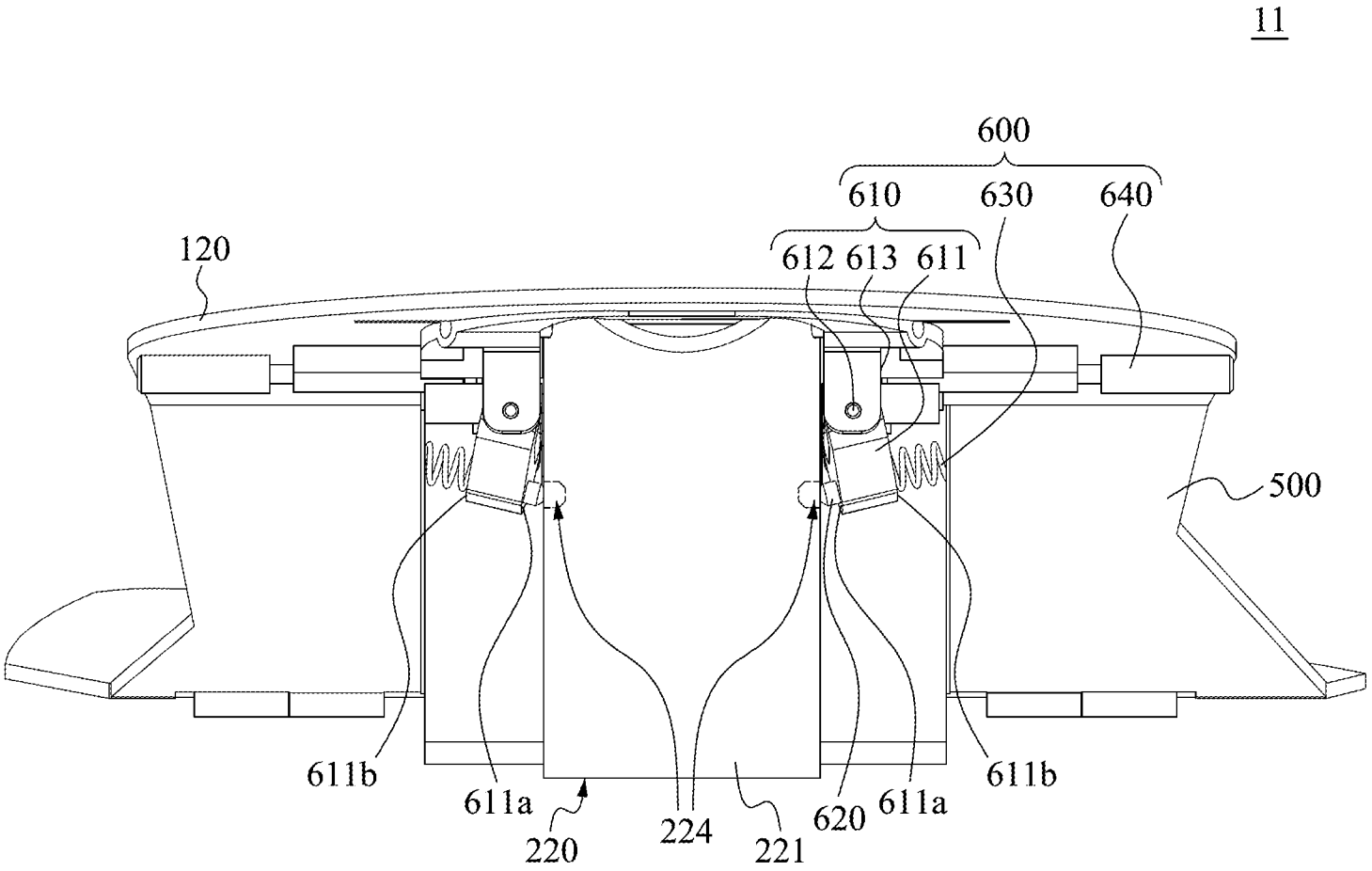
FIG. 6 depicts an operation schematic view of the locking mechanism of the shoe capable of adjusting heel height according to the embodiment of the disclosure.

FIG. 5 depicts a schematic view of a locking mechanism 600 of FIG. 2A. FIG. 6 depicts an operation schematic view of the locking mechanism 600 of the shoe 11 capable of adjusting heel height according to the embodiment of the disclosure. As shown in FIG. 5 and FIG. 6, two locking mechanisms 600 are respectively disposed on the two opposite sides of the shoe plate 100. Each of the locking mechanism 600 includes a frame body 610, a spring 630 and an operating portion 640. The frame body 610 is provided with a first end 611, a second end 613 and a pivotal portion 612. The pivotal portion 612 is disposed between the first end 611 and the second end 613, and is pivotally connected to the rear bracket 120 to each other so that the frame body 610 can be rotated according to the pivotal portion 612. One surface 611*a* of the first end 611 of the frame body 610 is provided with a fixing pin 620. The fixing pin 620 is pluggably inserted in one of the securing holes 224. The spring 630 is connected to a stationary member (e.g., the sole layer 500) and the other surface 611*b* of the first end 611 of the frame 610 for pushing the fixing pin 620 back into the securing hole 224. One end of the operating portion 640 is abutted against the second end 613 of the frame body 610, and the other end of the operating portion 640 is exposed outwards from the shoe 11. Thus, when the spring 630 continues to abut against the fixing pin 620 for being inserted into one of the securing holes 224, since the movement of the sleeve 221 is restricted by the fixing pin 620, the length of the telescopic linkage rack 210 which can be changed is also limited. On the other hand, as shown in FIG. 6, when a user presses the operating portions 640 of the locking mechanisms 600 simultaneously to push the second end 613 of the frame body 610, each of the operating portions 640 rotates the frame body 610 so as to withdraw the fixing pin 620 back from the securing hole 224 with the rotation of the frame body 610.

However, the disclosure is not limited thereto, except the locking mechanism 600 having the frame body 610, the spring 630, and the operating portion 640 therein, as long as the telescopic support member 220 can be limited to determine the length of the telescopic support member 220 correspondingly, any specific form of the locking mechanism is not limited in the disclosure. For example, the locking mechanism includes a fixing pin (not shown). The fixing pin is a separate object, and the fixing pin is pluggably inserted into one of the fixing holes independently for restricting the movement of the sleeves.

Figure 7A:
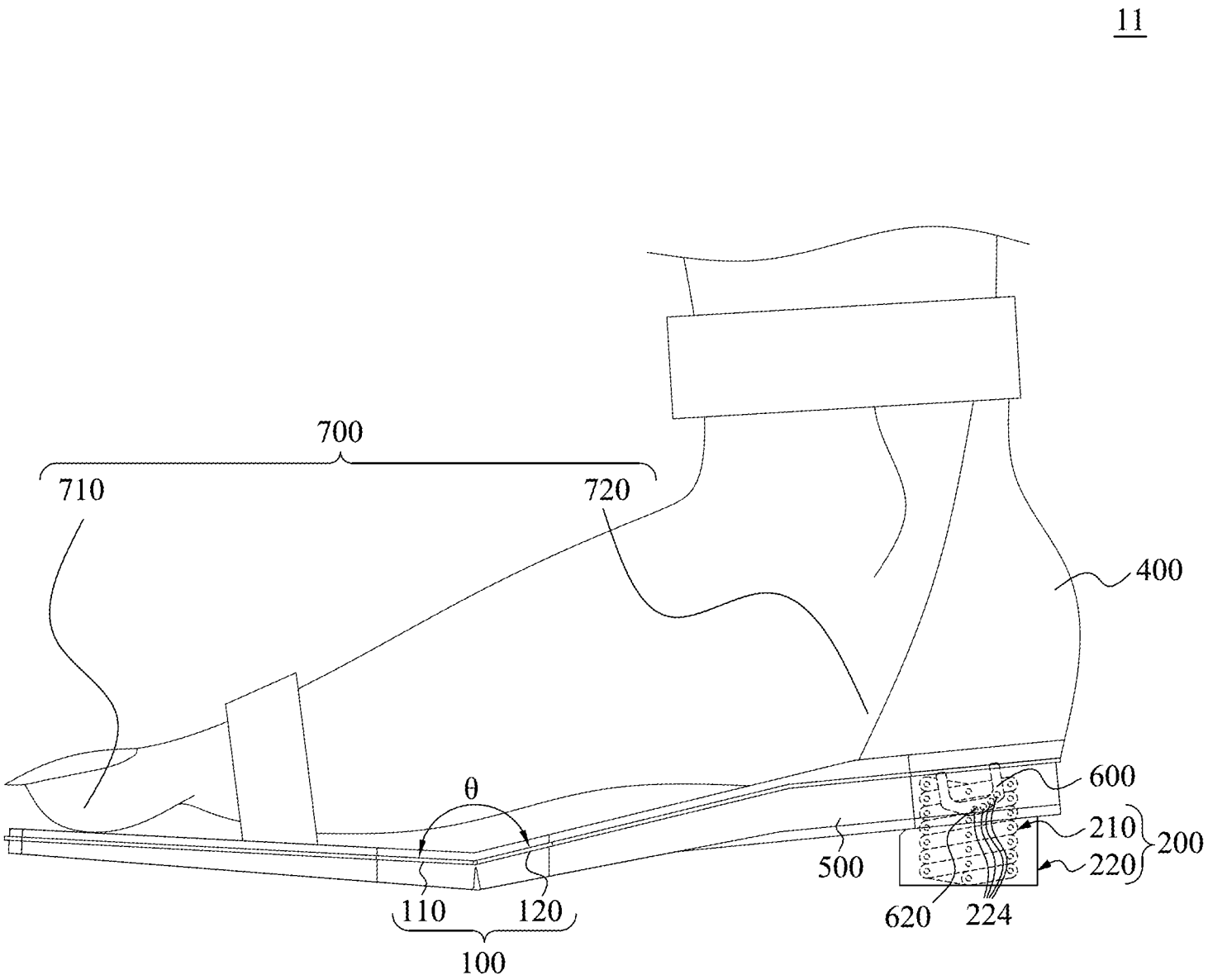
FIG. 7A-FIG. 7C depict continuous operation schematic views of the shoe capable of adjusting heel height according to the embodiment of the disclosure.
Figure 7B:
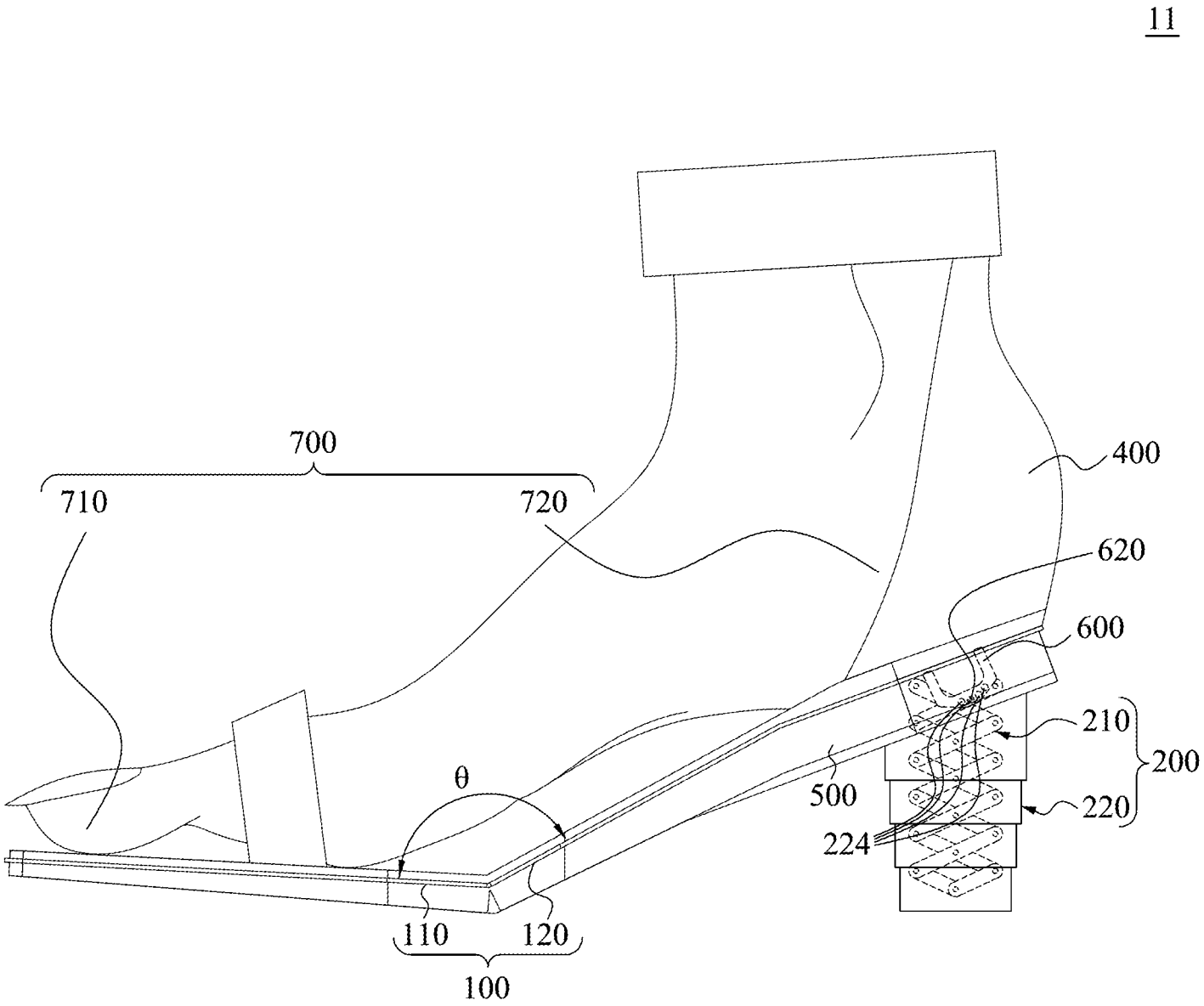
Figure 7C:
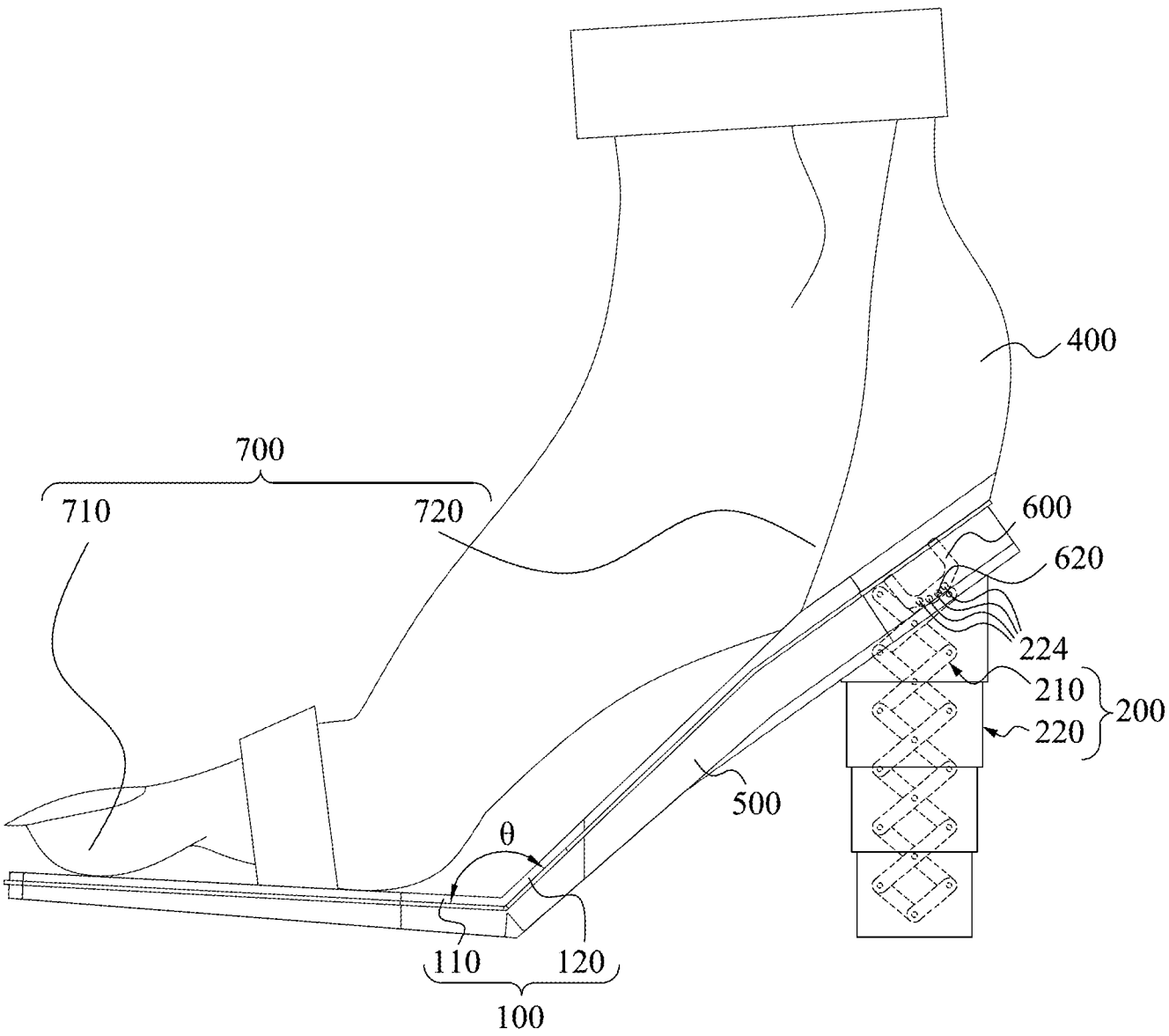

FIG. 7A-FIG. 7C depict continuous operation schematic views of the shoe 11 capable of adjusting heel height according to the embodiment of the disclosure. As shown FIG. 7A, the shoe body 400 and the show plate 100 mutually define a space for accommodating a single human foot 700. When the single human foot 700 puts on the shoe of the embodiment, the human foot 700 of the user is substantially placed on the shoe plate 100 in which the front bracket 110 bears the toe part 710 of the human foot 700, and the rear bracket 120 bears the heel part 720 of the human foot 700.

Thus, when the heel height of the shoe is desired to be increased, the user first presses the operating portions 640 of the locking mechanisms 600 to withdraw the fixing pin 620 back from the securing hole 224 thereby releasing the restriction for the telescoping of the telescopic support member 220 (refer to FIG. 6); next, as shown in FIG. 7B, the user lifts the heel part 720 to bend the toe part 710 in a certain angle so as to decrease the included angle 9 between the front bracket 110 and the rear bracket 120. At this moment, since the retractable shoe-heel 200 begins to elongate, the fixing pin 620 withdrawn out from the securing hole 224 starts to slide on the surface of the outermost sleeve 221; after the fixing pin 620 extends into another securing hole 224 again, another length of the retractable shoe-heel 200 exposed outwardly can be determined. Similarly, as shown in FIG. 7C or FIG. 3, when a larger heel height is required, the user can continue to bend the toe part 710 to reduce the included angle θ between the rear bracket 120 and the front bracket 110, so that the length of the retractable shoe-heel 200 can be increased again.

Thus, the extending length of the telescopic support member in the embodiment can be controlled to meet the user's requirements in accordance with the bending degrees of the shoe plate, thereby solving the problem that the user must have high-heel shoes with different heel heights at the same time.

It is noted, the number of the retractable shoe-heel, the linking member, the front bracket, the rear bracket, the first to fourth pivots and the lock mechanism illustrated above are only exemplary, not for limitations to the disclosure. One with ordinary skill in the field of the disclosure may adjust the number of the aforementioned elements according to the actual requirements.

Although the disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A shoe capable of adjusting heel height, comprising:

a front bracket;

a rear bracket rotatably connected to the front bracket, and formed with a recess;

a telescopic linkage rack pivotally connected to the rear bracket, and configured to be telescoped with the movement of the rear bracket, the telescopic linkage rack comprising a plurality of first shaft pins and a plurality of second shaft pins; a plurality of first connecting rods that are parallel one another; and a plurality of second connecting rods that are parallel one another, wherein each of the plurality of first connecting rods and each of the plurality of second connecting rods which are adjacent with each other are crossed to be pivotally connected to each other through one of the plurality of first shaft pins, and the plurality of first connecting rods and the plurality of second connecting rods are further pivotally connected to one another with an end-to-end manner through the plurality of second shaft pins, wherein, when the plurality of first connecting rods and the plurality of second connecting rods are rotated to gradually alter gaps between the plurality of first shaft pins from each other, the length of the telescopic linkage rack is correspondingly changed, and one of the first connecting rods is symmetrically pivotally connected to the rear bracket through the first shaft pin and the second shaft pin;

an extendable support member fixedly connected to the telescopic linkage rack, and configured to be simultaneously telescoped in the same direction and in the same proportion with the telescoping degree of the telescopic linkage rack, wherein the extendable support member comprises a plurality of sleeves arranged concentrically and telescopically sleeved one another in sequence, and the telescopic linkage rack is received in the sleeves;

a linking member pivotally connected to the front bracket and the extendable support member, and arranged spaced to the rear bracket, wherein the linking member is formed with a break, and the extendable support member is received within the recess and the break; and a locking mechanism configured to removably fix the extendable support member for limiting the telescoping of the extendable support member, one end of the front bracket is provided with a protruding rib, the rear bracket is pivotally connected to the one end of the front bracket through at least one first pivot, and pivotally connected to the telescopic linkage rack through at least two second pivots, the linking member is pivotally connected to the protruding rib through at least one third pivot, and pivotally connected to the extendable support member through at least one fourth pivot, wherein a four-bar linkage assembly is collectively defined by the protruding rib of the front bracket, the rear bracket, the telescopic linkage rack, the extendable support member and the linking member, and the at least one first pivot, the at least two second pivots, the at least one third pivot and the at least one fourth pivot are parallel one another, wherein when the rear bracket is rotated towards the front bracket, the four-bar linkage assembly collectively elongates the telescopic linkage rack in a gravity direction.

2. The shoe capable of adjusting heel height of claim 1, wherein the rear bracket is pivotally connected to one of the plurality of first connecting rods through one of the plurality of first shaft pins and one of the plurality of second shaft pins, wherein, when the rear bracket moves the telescopic linkage rack to change the length of the telescopic linkage rack correspondingly, the telescopic linkage rack is moved laterally.

3. The shoe capable of adjusting heel height of claim 2, wherein at least two of the plurality of first shaft pins are fixedly connected to at least two of the plurality of sleeves in sequence along a major axis direction of the extendable support member.

4. The shoe capable of adjusting heel height of claim 3, wherein the innermost one of the plurality of sleeves is formed with a through space therein, and the telescopic linkage rack is received within the through space.

5. The shoe capable of adjusting heel height of claim 3, wherein the outermost one of the plurality of sleeves is formed with a plurality of securing holes, wherein the plurality of securing holes are arranged along an arc-lined arrangement, wherein each of the plurality of securing holes corresponds to one of various lengths that the telescopic linkage rack is able to be changed correspondingly; and the locking mechanism comprises a fixing pin, the fixing pin is pluggably inserted one of the plurality of securing holes for fixing the plurality of sleeves to determine one of the various lengths that the telescopic linkage rack is able to be changed correspondingly.

6. The shoe capable of adjusting heel height of claim 5, wherein the locking mechanism further comprises:

a frame body having a first end, a second end and a pivotal portion disposed between the first end and the second end, wherein the fixing pin is disposed on the first end of the frame body;

a spring connected to the first end of the frame body, for pushing the fixing pin back to the one of the plurality of securing holes; and an operating portion in which one end of the operating portion is abutted against the second end of the frame body, and the other end of the operating portion is exposed outwards from the shoe, wherein, when the operating portion rotates the frame body, the fixing pin is withdrawn from the one of the plurality of securing holes with the rotation of the frame body to release from fixing the plurality of sleeves.

7. A shoe capable of adjusting heel height, comprising:

a shoe body;

a shoe sole layer having a penetrating opening; and a four-bar linkage assembly connected to the shoe body and the shoe sole layer, and the four-bar linkage assembly comprising:

a front bracket provided with a protruding rib;

a rear bracket rotatably connected to the front bracket and formed with a recess;

a retractable shoe-heel retractably received within the penetrating opening, and pivotally connected to the rear bracket, the retractable shoe-heel comprising a telescopic linkage rack and an extendable support member, the telescopic linkage rack that is pivotally connected to the rear bracket, received within the extendable support member, and the extendable support member that is fixedly connected to the telescopic linkage rack, and configured to be simultaneously telescoped in the same direction and in the same proportion with the telescoping degree of the telescopic linkage rack; and a linking member arranged spaced to the rear bracket, and pivotally connected to the protruding rib and the retractable shoe-heel, and the linking member is formed with a break, and the retractable shoe-heel is received within the penetrating opening, the recess and the break, wherein the telescopic linkage rack is configured to be telescoped with the movement of the rear bracket and the linking member; and a locking mechanism configured to removably fix the retractable shoe-heel for limiting the telescoping of the retractable shoe-heel, the telescopic linkage rack comprising a plurality of first shaft pins and a plurality of second shaft pins; a plurality of first connecting rods that are parallel one another; and a plurality of second connecting rods that are parallel one another, wherein each of the plurality of first connecting rods and each of the plurality of second connecting rods which are adjacent with each other are crossed to be pivotally connected to each other through one of the plurality of first shaft pins, and the plurality of first connecting rods and the plurality of second connecting rods are further pivotally connected to one another with an end-to-end manner through the plurality of second shaft pins, wherein, when the plurality of first connecting rods and the plurality of second connecting rods are rotated to gradually alter gaps between the plurality of first shaft pins from each other, the length of the telescopic linkage rack is correspondingly changed, and one of the first connecting rods is symmetrically pivotally connected to the rear bracket through the first shaft pin and the second shaft pin, wherein, when the linkage constrained assembly is operated to be retracted, the retractable shoe-heel is retracted with the movement of the linking member and the rear bracket for changing a length of the retractable shoe-heel, the rear bracket is pivotally connected to one end of the front bracket through at least one first pivot, and pivotally connected to the telescopic linkage rack through at least two second pivots, the linking member is pivotally connected to the protruding rib through at least one third pivot, and pivotally connected to the extendable support member through at least one fourth pivot, wherein the at least one first pivot, the at least two second pivots, the at least one third pivot and the at least one fourth pivot are parallel one another, wherein when the rear bracket is rotated towards the front bracket, the four-bar linkage assembly collectively elongates the telescopic linkage rack in a gravity direction.

8. The shoe capable of adjusting heel height of claim 7, wherein the rear bracket is pivotally connected to one of the plurality of first connecting rods through one of the plurality of first shaft pins and one of the plurality of second shaft pins, wherein, when the rear bracket moves the telescopic linkage rack to change the length of the telescopic linkage rack correspondingly, the telescopic linkage rack is moved laterally.

9. The shoe capable of adjusting heel height of claim 8, wherein the extendable support member comprises a plurality of sleeves which are arranged concentrically and telescopically sleeved one another in sequence, wherein at least two of the plurality of first shaft pins are fixedly connected to at least two of the plurality of sleeves in sequence along a major axis direction of the extendable support member.

10. The shoe capable of adjusting heel height of claim 9, wherein the innermost one of the plurality of sleeves is formed with a through space therein, and the telescopic linkage rack is received within the through space.

11. The shoe capable of adjusting heel height of claim 9, wherein the outermost one of the plurality of sleeves is formed with a plurality of securing holes, wherein the plurality of securing holes are arranged along an arc-lined arrangement, wherein each of the plurality of securing holes corresponds to one of various lengths that the telescopic linkage rack is able to be changed correspondingly; and the locking mechanism comprises a fixing pin, the fixing pin is pluggably inserted one of the plurality of securing holes for fixing the plurality of sleeves to determine one of the various lengths that the telescopic linkage rack is able to be changed correspondingly.

12. The shoe capable of adjusting heel height of claim 11, wherein the locking mechanism further comprises:

a frame body having a first end, a second end and a pivotal portion disposed between the first end and the second end, wherein the fixing pin is disposed on the first end of the frame body;

a spring connected to the first end of the frame body, for pushing the fixing pin back to the one of the securing holes; and an operating portion in which one end of the operating portion is abutted against the second end of the frame body, and the other end of the operating portion is exposed outwards from the shoe, wherein, when the operating portion rotates the frame body, the fixing pin is withdrawn from the one of the securing holes with the rotation of the frame body to release from fixing the plurality of sleeves.

* * * * *